US005830120A

United States Patent [19]

Rumesz et al.

[11] Patent Number: 5,830,120

[45] Date of Patent: Nov. 3, 1998

[54] APPARATUS FOR ADJUSTING THE FOLDING JAWS OF A FOLDING JAW CYLINDER

[75] Inventors: Franz Rumesz, Augsburg; Thomas Körting, Rehling, both of Germany

[73] Assignee: MAN Roland Druckmaschinen AG, Offenbach am Main, Germany

[21] Appl. No.: 639,956

[22] Filed: Apr. 29, 1996

[30] Foreign Application Priority Data

Apr. 29, 1995 [DE] Germany ..... 295 07 222.9

[51] Int. Cl.[6] ..... B42C 1/00; B42C 1/04

[52] U.S. Cl. ..... 493/424; 493/471; 493/474

[58] Field of Search ..... 493/424, 425, 493/426, 427, 428, 429, 430, 431, 432, 475, 476, 471, 477, 478

[56] References Cited

U.S. PATENT DOCUMENTS

| | | | |
|---|---|---|---|
| 3,865,361 | 2/1975 | Neal | 493/431 |
| 4,075,896 | 2/1978 | Pessina | 493/424 |
| 4,352,671 | 10/1982 | Peterson | 493/424 |
| 4,380,449 | 4/1983 | Michalik | 493/424 |
| 5,000,433 | 3/1991 | Prum | 493/424 |
| 5,057,064 | 10/1991 | Michalik | 493/424 |
| 5,096,175 | 3/1992 | Lange | 270/49 |
| 5,122,109 | 6/1992 | Kubota | 493/431 |
| 5,201,701 | 4/1993 | Roettger | 493/425 |
| 5,215,014 | 6/1993 | Burger | 493/424 |
| 5,417,642 | 5/1995 | Boronka | 493/427 |
| 5,468,209 | 11/1995 | Rohrhiursch | 493/424 |
| 5,507,714 | 4/1996 | Furuta | 493/424 |
| 5,571,069 | 11/1996 | Shah | 493/425 |

FOREIGN PATENT DOCUMENTS

| | | |
|---|---|---|
| 2 322 078 | 1/1982 | France . |
| 2 011 661 | 7/1971 | Germany . |
| 2537920 | 3/1977 | Germany . |
| 132004 | 8/1978 | Germany . |
| 4035617 | 7/1991 | Germany . |

*Primary Examiner*—John Sipos
*Assistant Examiner*—Christopher W. Day
*Attorney, Agent, or Firm*—Cohen, Pontani, Lieberman & Pavane

[57] ABSTRACT

An apparatus for adjusting folding jaws of a folding jaw cylinder having an axle on which a first cylinder part supporting at least one uncontrolled folding jaw and a second cylinder part supporting at least one controlled folding jaw are provided so as to be rotatable in opposite directions. The apparatus includes an adjusting spindle in one end of the axle of the folding jaw cylinder, two slide members, and a housing attachable to the axle at an end face of the cylinder parts and having two oppositely disposed two housing arms with radially directed guides. Each slide member being slidably arranged in a respective housing arm guide and have one end that engages with the adjusting spindle and another end that is engageable with one of the cylinder parts. Sliding pairs are provided for allowing sliding of the slides within the housing arms in a radial direction.

9 Claims, 2 Drawing Sheets

APPARATUS FOR ADJUSTING THE FOLDING JAWS OF A FOLDING JAW CYLINDER

BACKGROUND OF THE INVENTION

1. Field of the Invention

The invention is directed to an apparatus for adjusting the folding jaws of a folding jaw cylinder.

2. Description of the Prior Art

An apparatus for adjusting the folding jaws of a folding jaw cylinder is known from DE 40 35 617 A1. This apparatus has two cylinder body parts that support the folding jaws, are rotatable in opposite directions and are arranged on the axle of the folding jaw cylinder. The adjustment of the folding jaws is effected by the rotation of the two cylinder body parts in opposite directions. This is effected by the displacement of an adjusting spindle which is arranged in a cylinder pin so that a tappet or slide which is connected with the adjusting spindle is moved radially. The slide is screwed into a sliding piece which is connected with the cylinder body parts via a sliding pair and thus converts the sliding movement into a rotating movement of the cylinder body parts.

A disadvantage of this adjusting apparatus is that it is exposed to the effects of dust, which can lead to malfunction. Also, there is play in the screw connection between the slide and the sliding piece. Finally, the adjusting gear unit constitutes a large unbalanced mass which must be compensated for with a corresponding cost for balancing.

SUMMARY OF THE INVENTION

Accordingly, it is an object of the present invention to provide an apparatus for adjusting folding jaws which is characterized by low maintenance, high reliability and advantageous manufacturing possibilities.

Pursuant to this object, and others which will become apparent hereafter, one aspect of the present invention resides in an apparatus for adjusting the folding jaws of a folding jaw cylinder, which apparatus includes a housing that is attached to the axle of the folding jaw cylinder and is arranged at an end face of the cylinder parts of the folding jaw cylinder. The housing has two oppositely disposed arms which are each configured to guide one of two slide members. An adjusting spindle is provided at one end of the axle. A first end of each slide engages the adjusting spindle, and a second end of each slide engages one of the two cylinder parts. This engagement of the slide with the spindle or cylinder parts takes place via the intermediary of a sliding pair.

The housing protects the slides and sliding pair from the effects of dust. Furthermore, this encapsulation enables a good supply of lubricant to the moving parts of the gear unit. In all, a highly reliable apparatus is achieved in this way. Moreover, this apparatus can have a robust design. Since the housing arms and adjusting elements are arranged opposite one another, they do not produce an unbalanced mass. Therefore, the expenditure on balancing is reduced.

In a further embodiment, the gear connections between the slides and adjusting spindle and the cylinder parts are constructed to be self-locking so that there is no need for an additional clamping device. This contributes to the fact that the apparatus can be produced in a simple manner from few parts.

Pursuant to a further embodiment of the invention, each slide includes a pin which makes up one part of the sliding pair. The pin has parallel plane surfaces that extend diagonally relative to the sliding direction of the slide. The other piece of the sliding pair is rotatably supported in an end face of the respective cylinder part and has an end face with a slot. The pin of the slide engages in the slot in the end face of the sliding piece.

In yet another embodiment of the invention the adjusting spindle is supported in the axle of the folding jaw cylinder so as to be axially displaceable. The adjusting spindle has two grooves that extend diagonally relative to the sliding direction of the slide. One of the slides engages in each groove via a projection.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
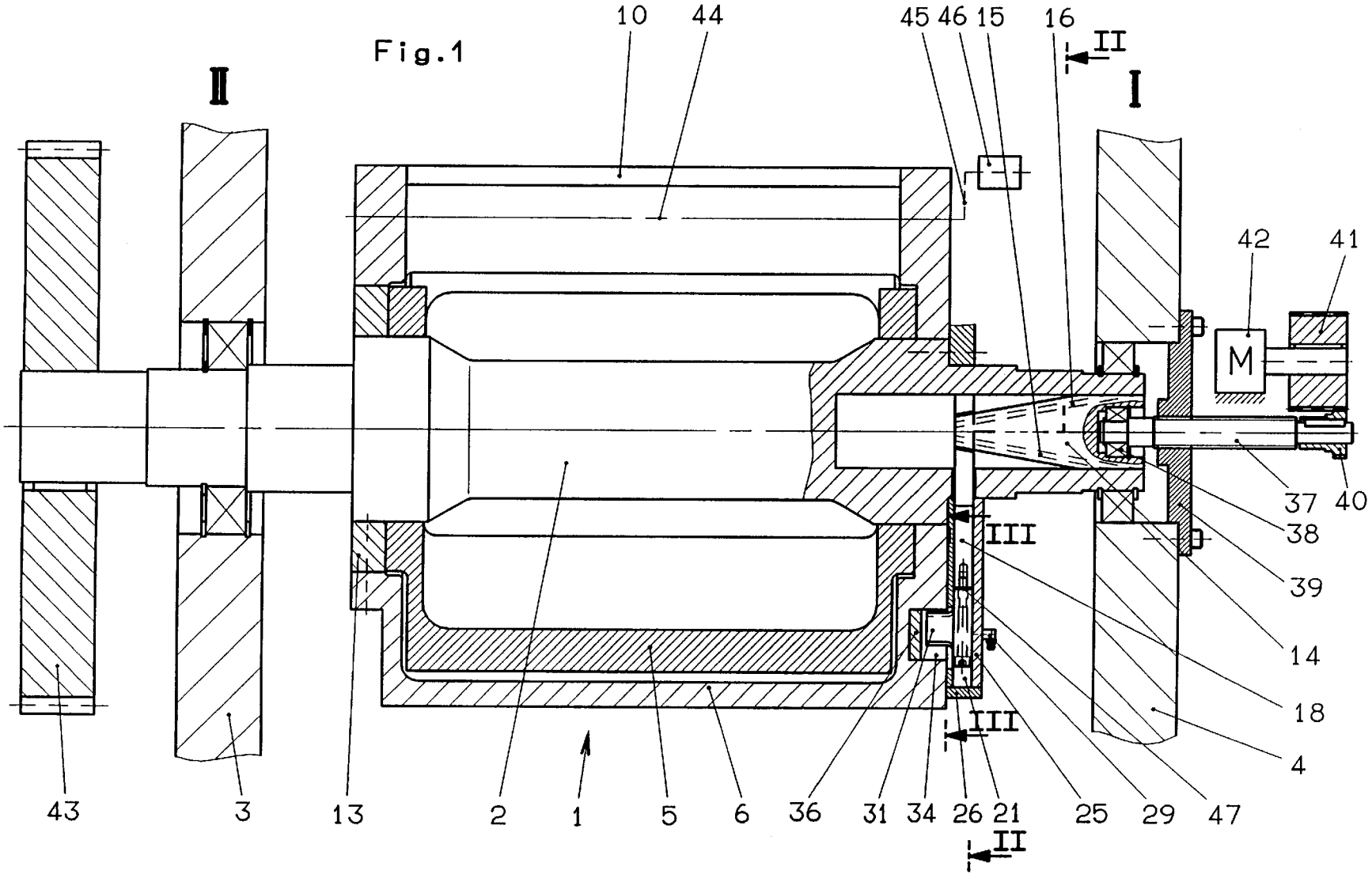
FIG. 1 is a longitudinal section of a folding jaw cylinder in (section I—I according to FIG. 2)

The folding jaw cylinder 1 shown in FIG. 1 is supported in side walls 3, 4 of a frame by its axle 2. The body of the folding jaw cylinder 1 is formed of a first cylinder part 5 and a second cylinder part 6 which are supported in a rotatable manner on the axle 2. The first cylinder part 5 carries three uncontrolled folding jaws 7, 8, 9, and the second cylinder part 6 supports three controlled folding jaws 10, 11, 12 (FIG. 2) which are distributed uniformly around the circumference of the folding jaw cylinder 1, in each instance. Thus, in the illustrated embodiment, the folding jaw cylinder 1 is formed of three parts. The folding jaw cylinder could also be outfitted, for example, with only two or with four uncontrolled and controlled folding jaws. The second cylinder part 6 substantially comprises the outer surface of the folding jaw cylinder 1 and is recessed at the locations where the folding jaws are arranged. The first cylinder part 5 is constructed in a star-shaped maimer, one of the uncontrolled folding jaws 7, 8, 9 being arranged at each of its points. The cylinder parts 5, 6 can also be shaped differently. For example, each of them can comprise parts of the outer surface of the cylinder as is shown in DE 40 35 617 A1. The first and second cylinder parts 5, 6 are fitted to the axle 2 so as to be nested one within the other. A ring 13 is then inserted into a first end of the second cylinder part 6 and screwed tight to hold the first cylinder part 5 in place.

Figure 2:
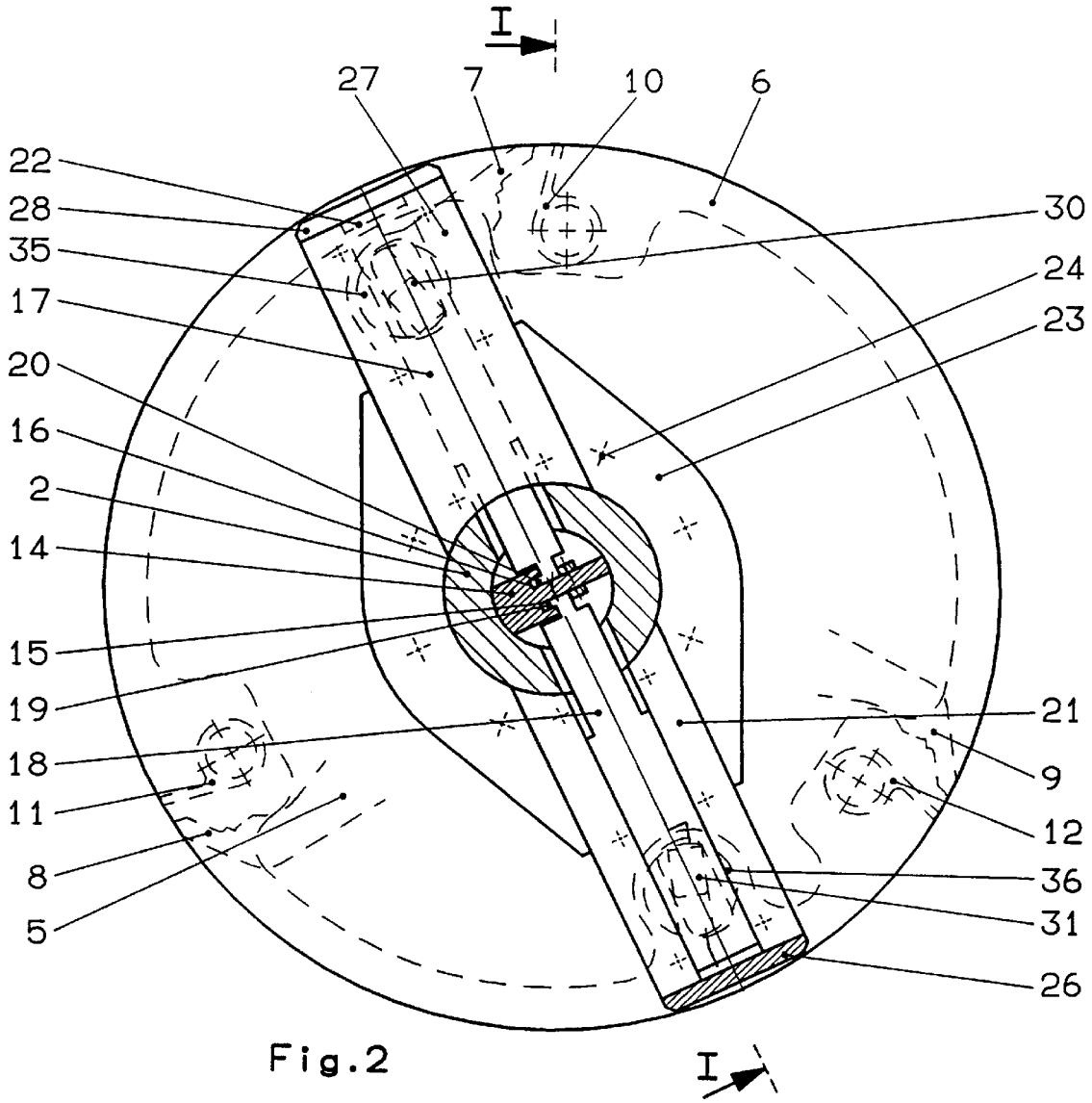
FIG. 2 is a cross-section of the folding jaw cylinder according to FIG. 1 in (section II—II according to FIG. 1)
Figure 3:
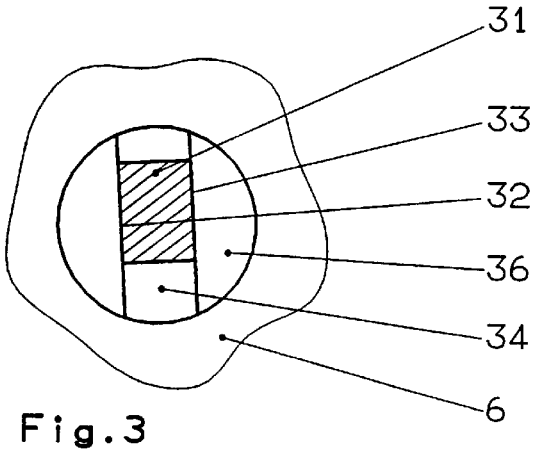
FIG. 3 is a section III—III according to FIG. 1.

An adjusting spindle 14 is arranged in the axle 2 of the folding jaw cylinder 1 and is displaceable in the axial direction. The spindle 14 has two grooves 15, 16 that extend diagonally to the sliding direction. A slide 17, 18 positively engages in each groove 15, 16 via a projection 19, 20 (FIGS. 1, 2). This type of V-gearing is advantageously constructed so as to be self-locking, i.e., with a suitably small diagonal position of the grooves 15, 16. The adjusting spindle 14 could also have a different kind of drive connection with the slides 17, 18, e.g., via eccentrics, in which case the adjusting movement of the adjusting spindle 14 would be a rotating movement. The slides 17, 18 are arranged radially and are guided, respectively, in a housing arm 21, 22 of a housing 23. The housing 23 is mounted to a collar of the axle 2 by screws 24. The guides of the housing arms 21, 22 for the slides 17, 18 are closed by covers 25 to 28 so that the slides 17, 18 and the sliding members, which will be described hereinafter, are protected from dust. Further, a good supply of lubricant can be provided for these elements via a spherical lubricating nipple 29 provided in the cover 25, as shown in FIG. 1.

Each slide 17, 18 carries a pin 30, 31 with parallel plane surfaces 32, 33 extending diagonally to the sliding direction of the slide 17, 18. The inclinations of the plane surfaces 32, 33 are the same magnitude relative to the sliding direction, but are constructed oppositely. The direction of inclination is optional within the limits of this condition. If the inclinations are not of the same magnitude, the uncontrolled and controlled folding jaws 7 to 12 are not adjusted by the same amount when actuated in the manner described hereinafter. Each pin 30, 31 projects into a slot 34 at the end face of a sliding piece 35, 36. The sliding piece 35 is rotatably supported in the end face of the first cylinder part 5 and the sliding piece 36 is rotatably supported in the end face at a second end of the second cylinder part 6.

For displacing the adjusting spindle 14, it is acted upon by a threaded spindle 37. The spindle 14, which rotates during the operation of the folding jaw cylinder 1, is connected with the threaded spindle 37, which is stationary per se, by a roller bearing 38 that is arranged in a bore hole of the adjusting spindle 14. The inner ring of the rolling bearing 38 rests on a shoulder of the threaded spindle 37. The threaded spindle 37 is screwed into a cover 39, which is fixed to the sidewall 4 of the frame and carries a toothed wheel 40 which engages a pinion 41 of a servomotor 42 for rotating the threaded spindle 37.

Further, a toothed wheel 43 is arranged at an end of the axle 2 opposite the adjusting spindle, for driving the folding jaw cylinder 1. Finally, an example of the actuation of the controlled folding jaw 10 is shown in FIG. 1. The controlled folding jaw 10 is secured to a spindle 44, shown schematically, on which a roller lever 45 is supported with a cam roller 46. The latter cooperates with a cam disk, not shown.

The folding jaws 7 to 12 are adjustable during operation, that is, during the rotation of the folding jaw cylinder 1. The uncontrolled folding jaws 7 to 9 and the controlled folding jaws 10 to 12 can be moved toward one another or away from one another by equal amounts in order to adapt to different product thicknesses or in order to change the clamping force. For this purpose, the threaded spindle 37 is actuated by the servomotor 42 via the pinion 41 and the toothed wheel 40. Depending on the rotating direction, the threaded spindle 37 is screwed into or out of the cover 39 and in so doing displaces the adjusting spindle 14. The adjusting spindle 14 in turn causes the slides 17, 18 engaging in its grooves 15, 16 to be displaced radially. The slides 17, 18 in turn convert the radial movement into an oppositely directed rotating movement of the first and second cylinder parts 5, 6 due to the diagonal plane surface 32, 33 of their pins 30, 31 in cooperation with the sliding pieces 35, 36. The folding jaws 7, 8, 9 and 10, 11, 12 supported by the cylinder parts 5, 6 are adjusted accordingly. In the diagonal position of the plane surfaces 32, 33 of the pins 30, 31 (FIG. 2), the uncontrolled and controlled folding jaws 7 to 9 and 10 to 12 move toward one another during the movement of the adjusting spindle 14, e.g., into the axle 2; that is, the distance between the folding jaws is reduced.

In order to adjust the uncontrolled folding jaws 7 to 9 relative to the controlled folding jaws 10 to 12 during assembly, the slide 17 is advantageously formed of two parts which are screwed together with the intermediary of a disk 47 which is adapted with respect to thickness (FIG. 1). In this way, depending on the thickness of the disk 47, the radial position of the pin 30 and accordingly the rotational position of the first cylinder part 5 with respect to the second cylinder part 6 can be adjusted.

The invention is not limited by the embodiments described above which are presented as examples only but can be modified in various ways within the scope of protection defined by the appended patent claims.

We claim:

1. An apparatus for adjusting folding jaws of a folding jaw cylinder having an axle on which a first cylinder part supporting at least one first folding jaw and a second cylinder part supporting at least one second folding jaws are mounted so as to be rotatable so as to move the folding jaws toward and away from one another, comprising:

an adjusting spindle movably mounted in a first axle end of the axle of the folding jaw cylinder;

means for moving the spindle;

first and second slide members;

a housing connected to the axle at an end face of the cylinder parts and having first and second oppositely disposed housing arms with radially directed guide channels, each slide member being slidable in a respective one of the housing arm guide channels and having a first end engaged with the adjusting spindle so as to be linearly movable by movement of the spindle, and a second end that is engaged with one of the cylinder parts; and sliding pair means connected between the a second end of the slide members and the first and second cylinder parts for transferring linear sliding movement of the slide members within the housing arms in a radial direction to rotary movement of the first and second cylinder parts so that the folding jaws are adjusted relative to one another by the rotary movement of the first and second cylinder parts.

2. An apparatus according to claim 1, wherein the sliding pair means includes, for each slide member, a pin having parallel plane surfaces that extend diagonally relative to a sliding direction of the slide member, and a sliding piece having an end face with a slot, the pin engaging in the slot in the end face of the sliding piece, the pin being mounted to one of the slide member and an end face of one of the cylinder parts, and the sliding piece being rotatably mounted to the other of the slide member and the end face of the cylinder part.

3. An apparatus according to claim 1, wherein the adjusting spindle is mounted in the axle of the folding jaw cylinder so as to be axially displaceable, the spindle having two grooves that extend diagonally relative to the sliding direction, each of the slide members having a projection at the one end that engages in one of the spindle grooves.

4. An apparatus according to claim 3, and further comprising means for axially displacing the adjusting spindle in the axle.

5. An apparatus according to claim 4, wherein the means for axially displacing the adjusting spindle includes a threaded spindle, roller bearing means for connecting one end of the threaded spindle to the adjusting spindle, a toothed wheel mounted on a second end of the threaded spindle, and a servomotor having a pinion engaged with the toothed wheel for driving the threaded spindle.

6. An apparatus according to claim 1, wherein the first and second housing arms include cover members that cover the guide channels for the first and second slide members.

7. An apparatus according to claim 6, and further comprising a lubricant nipple mounted on the cover so as to communicate with the guide channels.

8. An apparatus according to claim 1, wherein each of the slide members includes two parts and a disk arranged between the two parts, the two parts being screwed together with the disk therebetween.

9. A combination of a folding jaw cylinder and an apparatus for adjusting folding jaws of the folding jaw cylinder, the combination comprising:

a folding jaw cylinder having: an axle; a first cylinder part mounted on the axle; at least one first folding jaw mounted on the first cylinder part;

a second cylinder part mounted on the axle; and at least one second folding jaw mounted on the second cylinder part, the first and second cylinder parts being provided so as to be rotatable so as to move the folding, jaws toward and away from one another; and a folding jaw adjusting apparatus including: an adjusting spindle slidably mounted in a first end end of the axle of the folding jaw cylinder; means for sliding the spindle; a housing attached to the axle at an end face of the cylinder parts, the housing having first and second oppositely, radially disposed arms with guide channels formed therein; first and second slide members, each slide member being slidable in a respective housing arm guide channel and having a first end engaged with the adjusting spindle so as to be linearly movable by movement of the adjusting spindle, and a second end that is engaged with one of the cylinder parts; and sliding pair means connected between the a second end of the slide members and the first and second cylinder parts for transferring linear sliding movement of the slides within the housing arms in a radial direction to rotary movement of the first and second cylinder parts to adjust the folding jaws so that the folding jaws are adjusted by the rotary movement of the first and second cylinder parts.

* * * * *